US006049174A

United States Patent [19]

Pirrie et al.

[11] Patent Number: 6,049,174

[45] Date of Patent: Apr. 11, 2000

[54] HIGH COULOMBIC SWITCH GAS DISCHARGE DEVICE

[75] Inventors: Colin Archibold Pirrie, Chelmsford; Clive Anthony Roberts, Witham; Kenneth Cook, Northwood; Cliff Robert Weatherup, Chelmsford, all of United Kingdom

[73] Assignee: EEV Limited, Essex, United Kingdom

[21] Appl. No.: 08/875,746

[22] PCT Filed: Feb. 8, 1996

[86] PCT No.: PCT/GB96/00278

§ 371 Date: Aug. 4, 1997

§ 102(e) Date: Aug. 4, 1997

[87] PCT Pub. No.: WO96/24945

PCT Pub. Date: Aug. 15, 1997

[30] Foreign Application Priority Data

Feb. 8, 1995 [GB] United Kingdom ..... 9502423

[51] Int. Cl.[7] ..... H05B 37/00; H01J 1/46

[52] U.S. Cl. ..... 315/94; 313/592; 313/595

[58] Field of Search ..... 313/592, 590, 313/595, 603, 601, 613, 591; 315/94, 363, 76

[56] References Cited

U.S. PATENT DOCUMENTS

| | | | |
|---|---|---|---|
| 4,703,226 | 10/1987 | Menown | 313/595 |
| 5,075,592 | 12/1991 | Seeboeck et al. | 313/590 |

FOREIGN PATENT DOCUMENTS

| | | |
|---|---|---|
| 0337192 | 10/1989 | European Pat. Off. . |
| 559902 | 3/1944 | United Kingdom . |
| 788328 | 12/1957 | United Kingdom . |

*Primary Examiner*—David H. Vu
*Attorney, Agent, or Firm*—Donald C. Casey

[57] ABSTRACT

A device suitable for switching large currents includes, within a gas filled envelope, an anode, electrodes and a thermionic cathode. Initially the device holds off a voltage until a triggering pulse is applied to an electrode. This cause an electron current to be established between the thermionic cathode and the anode. When the current reaches a sufficiently large value further conduction through the device occurs via current drawn from the surface of the electrode in a cold cathode mode, bypassing the cathode.

9 Claims, 1 Drawing Sheet

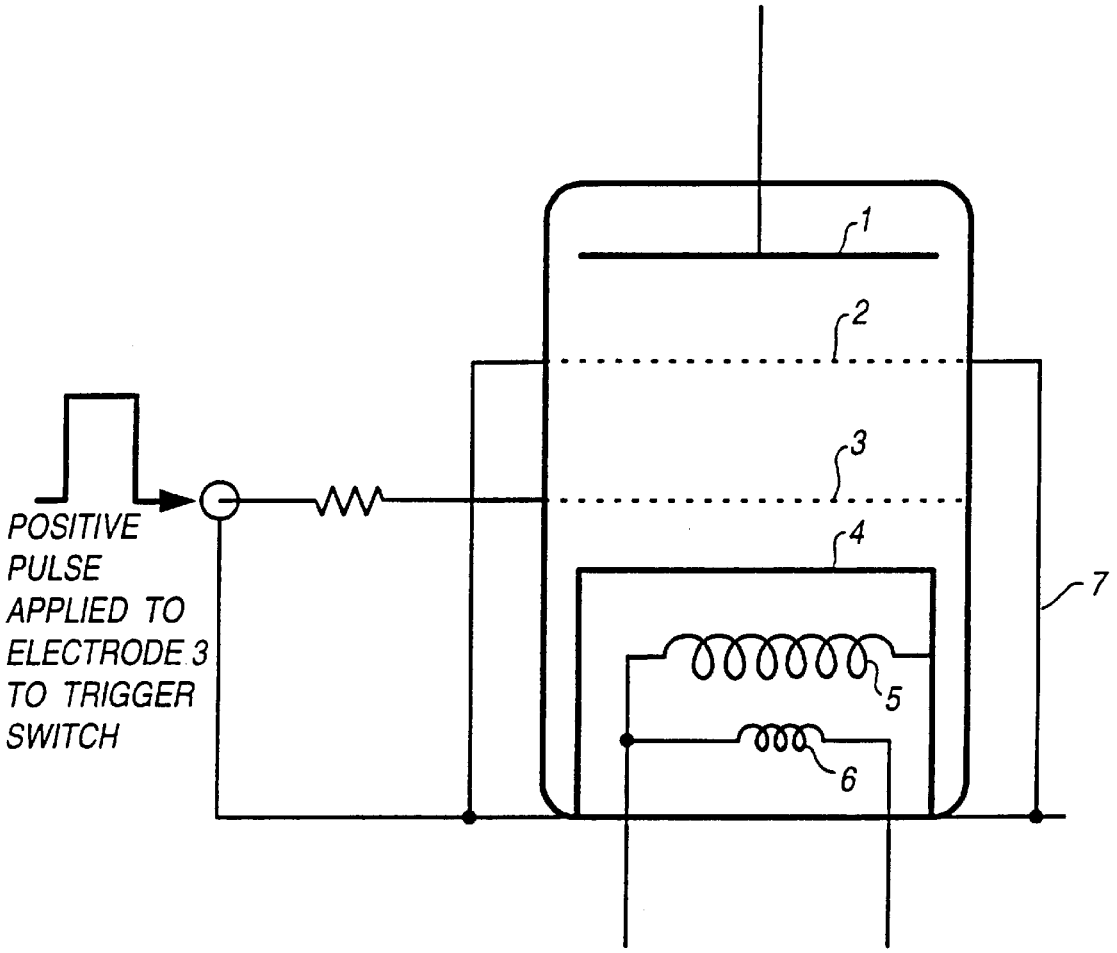
1
2
3
4
5
6
7
POSITIVE PULSE APPLIED TO ELECTRODE 3 TO TRIGGER SWITCH

HIGH COULOMBIC SWITCH GAS DISCHARGE DEVICE

CROSS REFERENCE TO RELATED APPLICATION

This application is related to PCT/GB 96/00278, filed Aug. 2, 1996.

This invention relates to gas discharge devices.

DESCRIPTION OF THE PRIOR ART

A thyratron is a known type of gas discharge device which, in a simple embodiment, includes a cathode, anode and intervening control electrode contained within a gas filled envelope. The thyratron is capable of holding off a voltage until a triggering pulse is applied to the control electrode and current is transmitted through the device.

SUMMARY OF THE INVENTION

Another type of device, described in EP-A-0 337 192, includes a gas discharge switch with at least a thermionic cathode, an anode and an electrode located therebetween.

The present invention seeks to provide a gas discharge device which is capable of handling large peak currents and high coulomb transfer.

According to the invention there is provided a gas discharge device comprising a gas filled envelope containing a thermionic cathode, an anode, and a first electrode which is electrically in parallel with the cathode and located between the anode and cathode wherein, during conduction through the device, electron current is initially derived from the cathode and subsequently, when the current reaches a sufficient magnitude, from a surface of the electrode in cold cathode mode.

By employing the invention a device may be provided having a triggering capability which is as reliable as that of a thyratron, but which also offers coulombic transfer capability at high peak current which may exceed existing thyratron capabilities by a factor of 10–100 in magnitude.

In one embodiment, electrical connection means between the first electrode and thermionic cathode is integral with the device and in another is provided by an external circuit in which the device is connected.

In a preferred embodiment, a second electrode is included and means for applying a triggering signal thereto for initiating conduction through the device.

Advantageous embodiments of the invention may hold-off positive (or negative) high voltage (up to 100 kV), and when triggered, conduct high peak currents (5–500 kA) with long pulse widths (10–100 microsecs). A device in accordance with the invention may act as a high coulombic switch in high energy capacitor banks and crowbar protection circuits for example.

BRIEF DESCRIPTION OF THE DRAWINGS

One way in which the invention may be performed is now described by way of example with reference to the accompanying drawing in which the sole FIGURE schematically illustrates a device in accordance with the invention.

DETAILED DESCRIPTION OF THE INVENTION

With reference to the FIGURE a sealed-off cylindrical device of metal and ceramic (or glass or other electrical insulator) construction includes an envelope which contains four electrodes, that is, an anode 1, thermionic cathode 4 and two electrodes 2 and 3 located between them. The device is filled with hydrogen or deuterium at a pressure in the region of 50–5000 mTorr, which is sustained by a titanium hydride heated reservoir 6. High voltage is held-off between the anode 1 and the adjacent electrode 2, in accordance with Paschen's Law.

The thermionic cathode 4 heated by a filament 5 provides a source of electrons to facilitate triggering and initiate conduction. The device is triggered by applying a positive pulse to electrode 3 with respect to the thermionic cathode 4. The applied positive pulse establishes a discharge in the region between the electrode and the thermionic cathode. The established discharge plasma diffuses through apertures in the electrode 3 and into the region between electrode 2 and electrode 3. The electric field from the high voltage gap between the anode 1 and the adjacent grid electrode 2 penetrates apertures in the grid electrode 2 and thus influences the plasma created by the trigger pulse. Electrons are accelerated by the influence of the high voltage field and cause further ionization which spreads plasma into the high voltage gap and initiates breakdown of the device. The high voltage applied between the anode 1 and electrode 2 falls rapidly to a low value and the switch becomes closed.

The conduction process then proceeds in two phases. During Phase 1, the thermionic cathode structure provides all the electron current conducted by the device. Current builds up in the external circuit until a point is reached when the apertures in electrode 2 can no longer sustain the current. At this point, Phase 2 of conduction is established when electron current is drawn from the upper surface of electrode 2 in cold-cathode mode. Phase 2 conduction then continues until the external circuit voltages fall to values close to zero. During Phase 2 conduction, current bypasses the thermionic cathode and electrode 3 by virtue of electrical conductor(s) 7, which may either be part of the device or may be added as part of the external circuit.

Phase 1 conduction creates ionized hydrogen plasma which provides a significant level of pre-ionization to facilitate the onset of Phase 2 conduction.

The high voltage gap formed by anode and grid electrode has dimensions and a geometry which are consistent with Paschen's Law but which also maintain high voltage reliability despite the surface damage which may occur to anode and adjacent electrodes during Phase 2 conduction.

We claim:

1. A gas discharge device comprising a gas filled envelope containing a thermionic cathode, an anode, and a first electrode which is electrically in parallel with the cathode and located between the anode and cathode wherein electron current is initially derived from the cathode and subsequently, when the current reaches a sufficient magnitude, from a surface of the electrode in cold cathode mode.

2. A device as claimed in claim 1 wherein electrical connection means between the first electrode and cathode is integral with the device.

3. A device as claimed in claim 1 wherein electrical connection means between the first electrode and cathode is part of an external circuit in which the device is connected.

4. A device as claimed in claim 1, and including a second electrode and means for applying a trigger signal thereto to initiate conduction through the device.

5. A device as claimed in claim 4 and wherein the first electrode is positioned between the anode and the second electrode.

6. A device as claimed in claim 1 wherein the device holds off a voltage of the order of 100 kV.

7. A device as claimed in claim 1 wherein the device holds off a voltage of the order of 100 kV.

8. A device as claimed claim 1 wherein the device conducts currents in the range 5 kA to 500 kA during operation.

9. A method of switching current using a device comprising a gas filled envelope containing a thermionic cathode, and anode and an electrode located between them, the method including the steps of: triggering the device into conduction; initially deriving electron current from the cathode; and subsequently, when the current reaches a sufficient magnitude, deriving electron current from a surface of the electrode in cold cathode mode.

* * * * *